United States Patent [19]

Kashimoto et al.

[11] 4,414,448

[45] Nov. 8, 1983

[54] VACUUM CIRCUIT INTERRUPTER

[75] Inventors: Yutaka Kashimoto, Tokyo; Shinzo Sakuma, Kawasaki; Junichi Warabi, Shizuoka; Yukio Kobari; Hidemi Kawaguchi, both of Tokyo, all of Japan

[73] Assignee: Kabushiki Kaisha Meidensha, Tokyo, Japan

[21] Appl. No.: 280,467

[22] Filed: Jul. 6, 1981

[30] Foreign Application Priority Data

Jul. 7, 1980 [JP] Japan ..... 55-92561

[51] Int. Cl.[3] ..... H01U 33/66

[52] U.S. Cl. ..... 200/144 B

[58] Field of Search ..... 200/144 B

[56] References Cited

U.S. PATENT DOCUMENTS

| | | | |
|---|---|---|---|
| 3,727,018 | 4/1973 | Wesoloski et al. | 200/144 B |
| 3,812,314 | 5/1974 | Nonken | 200/144 B |
| 4,077,114 | 3/1978 | Sakuma | 200/144 B |
| 4,271,340 | 6/1981 | Griesen | 200/144 B |
| 4,281,231 | 7/1981 | Griesen et al. | 200/144 B |

FOREIGN PATENT DOCUMENTS

| | | | |
|---|---|---|---|
| 1298448 | 12/1972 | United Kingdom | 200/144 B |

*Primary Examiner*—Robert S. Macon

*Attorney, Agent, or Firm*—Lowe, King, Price & Becker

[57] ABSTRACT

A vacuum circuit interrupter includes an evacuated envelope composed of a plastically deformable metallic cylinder and first and second insulating disks closing the opposite ends of the cylinder. Stationary and movable conductive rods project coaxially through the first and second disks respectively. Stationary and movable electrodes are connected to the stationary and movable rods in such a manner as to engage with each other when the movable rod moves toward the stationary rod and disengage with each other when the movable rod moves away from the stationary rod. A bellows surrounds the movable rod inside the envelope and is fixed at its one end to the movable rod and at its other end to the second disk in such a manner as to provide a seal about the movable rod to allow for movement thereof without impairing the vacuum inside the envelope. A first conductive shield surrounds the stationary rod inside the envelope. The first shield is fixed to the first disk in such a manner as to be isolated electrically from the stationary rod and the metallic cylinder. A second conductive shield surrounds the bellows. The second shield is fixed to the second disk in such a manner as to be isolated electrically from the movable rod and the metallic cylinder.

4 Claims, 4 Drawing Figures

VACUUM CIRCUIT INTERRUPTER

BACKGROUND OF THE INVENTION

1. Field of the Invention

This invention relates to a circuit interrupter and more particularly to an interrupter of the vacuum type which includes an evacuated envelope, in which a pair of movable and stationary contact rods are arranged to open or close a circuit.

2. Description of the Prior Art

In a vacuum circuit interrupter of the prior art, a pair of contacts engaging selectively with each other are housed within an evacuated envelope composed of a proper combination of insulating and metallic members, the former being made of glass or ceramic and the latter being made of an iron-nickel or iron-nickel-cobalt alloy having a coefficient of thermal expansion which closely matches that of the glass or ceramic. However, the iron-nickel or iron-nickel-cobalt alloy is relatively expensive.

SUMMARY OF THE INVENTION

It is an object of the present invention to provide a vacuum circuit interrupter which has relatively high durability.

It is another object of the present invention to provide a vacuum circuit interrupter which has relatively high reliability.

It is a further object of the present invention to provide a vacuum circuit interrupter which is relatively inexpensive.

A vacuum circuit interrupter of the present invention includes an evacuated envelope composed of a plastically deformable metallic cylinder and first and second insulating disks closing the opposite ends of the cylinder. Stationary and movable conductive rods project coaxially through the first and second disks respectively. Stationary and movable electrodes are attached to the stationary and movable rods respectively in such a manner as to engage with each other when the movable rod moves toward the stationary rod and disengage when the movable rod moves away from the stationary rod. A bellows surrounds the movable rod inside the envelope and is fixed at its one end to the movable rod and at its other end to the second disk in such a manner as to provide a seal about the movable rod to allow for movement thereof without impairing the vacuum inside the envelope. A first conductive shield surrounds the stationary rod inside the envelope. The first shield is fixed to the first disk in such a manner as to be isolated electrically from the stationary rod and the metallic cylinder. A second conductive shield surrounds the bellows. The second shield is fixed to the second disk in such a manner as to be isolated electrically from the movable rod and the metallic cylinder.

The above and other objects, features and advantages of the present invention will be apparent from the following description of a preferred embodiment thereof, taken in conjunction with the drawings.

DESCRIPTION OF THE PREFERRED EMBODIMENT

Figure 1:
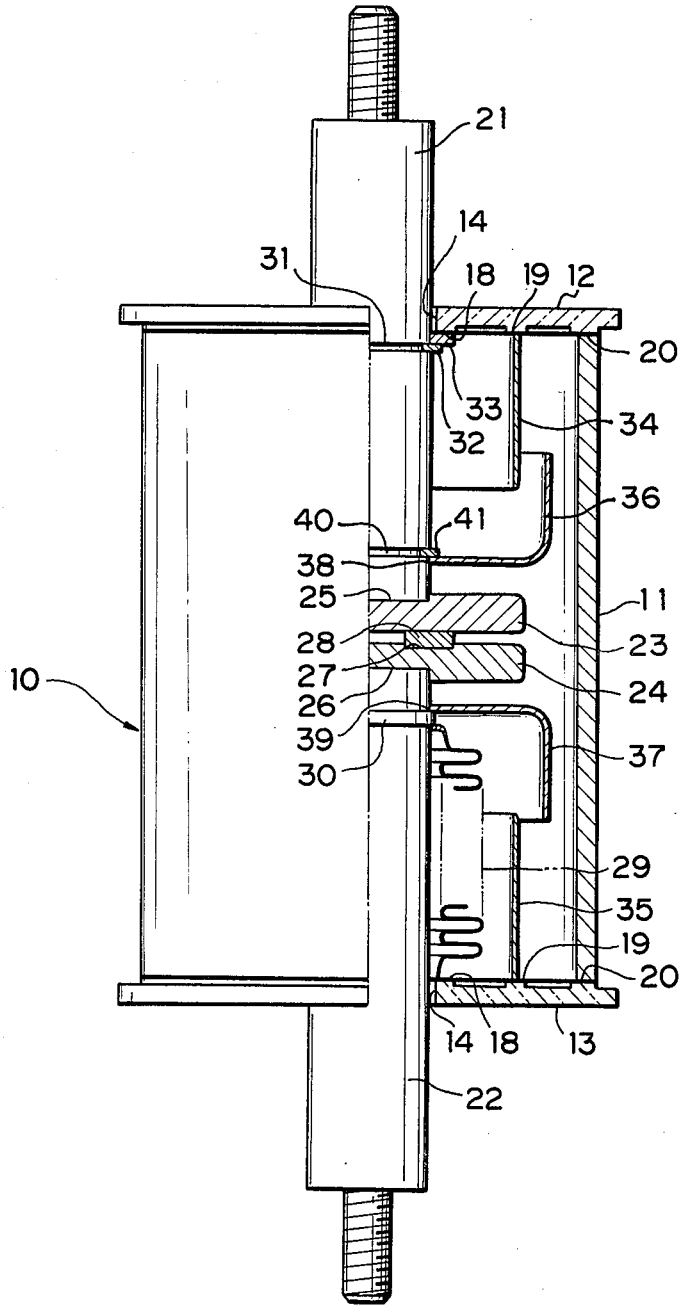
FIG. 1 is a longitudinally half-sectioned diagrammatic view of a vacuum circuit interrupter according to the present invention.

Referring to FIG. 1, there is shown a vacuum circuit interrupter of the present invention which has an evacuated housing or envelope 10 in its closed state. The envelope 10 consists of a metallic cylinder 11 and a pair of insulating disks 12 and 13 closing the opposite ends of the cylinder 11.

Figure 2:
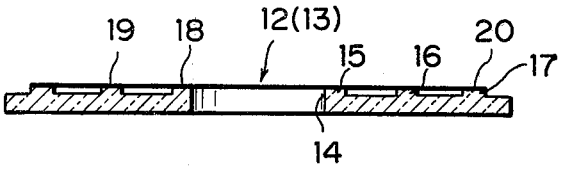
FIG. 2 is a section of the insulating disk of the vacuum circuit interrupter in FIG. 1 taken along the diameter line.

As is best illustrated in FIG. 2, each of the disks 12 and 13 has a circular center aperture 14 therein and concentrically arranged annular projections 15, 16 and 17 on the inner surface thereof. The annular projections 15, 16 and 17 are 0.1 to 0.5 mm in height and have flat surfaces covered with metalized layers 18, 19 and 20 respectively. The outermost metalized layers 20 have a diameter corresponding to that of the metallic cylinder 11, whose ends are brazed to the layers 20 to fix the insulating disks 12 and 13 thereto. The innermost metalized layers 18 are positioned on the peripheries of the apertures 14 in the disks 12 and 13.

The cylinder 11 is made of a plastically deformable metal, such as copper or iron, which is relatively inexpensive and is easy to deform plastically in the cooling process after brazing according to the thermal stress generated during brazing. Non-magnetic metal such as copper is more preferable to magnetic metal such as iron for the cylinder 11, because vibrating force exerted thereon by an alternating current passing through the interrupter is weaker than that on magnetic metal and consequently the interrupter has relatively high durability and reliability. If copper or iron supporting rings (not shown) are interposed between the cylinder 11 and the disks 12 and 13, the cylinder 11 may be made of austenitic stainless steel which is a non-magnetic material and has a comparatively high mechanical-strength. The disks 12 and 13 are made of an inorganic insulator, such as alumina ceramic or crystallized glass. The metalized layers 18, 19 and 20 are made of a manganese-titanium alloy or a molybdenum-manganese-titanium alloy which has a similar thermal expansion coefficient to that of alumina ceramic.

A pair of conductive, circular-section stationary and movable contact rods 21 and 22 respectively project through the apertures 14 in the upper and lower disks 12 and 13 respectively to enter the envelope 10 in such a manner as to extend coaxially along the cylinder 11, namely in an aligned configuration. The rods 21 and 22 are made of copper or a copper alloy. A pair of stationary and movable disk-shaped electrodes 23 and 24 are attached coaxially to the stationary and movable contact rods 21 and 22 respectively at the inner ends thereof. The stationary and movable electrodes 23 and 24 have circular recesses 25 and 26 respectively on their outer surfaces. The inner ends of the stationary and movable contact rods 21 and 22 are fitted into the recesses 25 and 26 respectively and brazed to the stationary and movable electrodes 23 and 24 respectively. The movable electrode 24 is formed with a coaxial annular groove 27 on its upper surface. The ring-shaped contact 28 is fitted into the groove 27 and is brazed to the movable electrode 24. The stationary contact rod 21 is secured to the upper disk 12, while the movable contact rod 22 is suitably mounted to allow vertical movement, as described hereinafter. When the movable contact rod 22 moves upward or toward the stationary contact rod 21, the contact 28 engages the stationary electrode 23 as shown in FIG. 1, thereby closing the interrupter. When the movable contact rod 22 moves downward or away from the stationary contact rod 21, the contact 28 disengages from the stationary electrode 23, thereby opening the interrupter. Suitable actuating means (not shown) is coupled to the movable contact rod 22 to drive the same upward or downward.

A flexible metallic bellows 29, made of austenitic stainless steel with a thickness of 0.1 to 0.2 mm, coaxially surrounds the movable contact rod 22 inside the envelope 10 to provide a seal about the rod 22 to allow for vertical movement thereof without impairing the vacuum inside the envelope 10. The bellows 29 is brazed at its upper end circumferentially to the lower surface of an annular flange 30 formed on the rod 22 near the upper end thereof, and at its lower end to the innermost metalized layer 18 on the lower disk 13. The stationary contact rod 21 is provided with an annular groove 31 on its periphery just below the upper disk 12 into which a ring 32 is fitted and brazed to the rod 21. An annular supporting member 33 made of copper or iron is provided between the ring 32 and the innermost metalized layer 18 on the upper disk 12 and is brazed to the ring 32 and the layer 18 to provide a seal about the rod 21. Thus the stationary contact rod 21 is secured to the upper disk 12.

A pair of cylindrical upper and lower shields 34 and 35 respectively each are coaxially brazed at one end to the intermediate metalized layers 19 on the upper and lower disks 12 and 13 respectively. The shields 34 and 35 are made of austenitic stainless steel, or may be made of plastically deformable copper or iron. The shields 34 and 35 are electrically isolated from the conductive rods 21 and 22, the metallic cylinder 11, and the bellows 29 to form therein a floating voltage to raize breakdown voltages along the inner surfaces of the upper and lower disks 12 and 13 respectively and to even out the distribution of the electric field inside the envelope 10. A pair of cup-shaped shields 36 and 37 are coaxially secured to the stationary and movable contact rods 21 and 22 respectively near their inner ends. The shields 36 and 37 are made of a similar metal to that forming the shields 34 and 35. The shields 36 and 37 are provided in their bases with coaxial apertures 38 and 39 respectively through which the rods 21 and 22 respectively pass, and have a greater diameter than that of the shields 34 and 35. The upper cup-shaped shield 36 faces upward in such a manner as to cover the opening of the upper cylindrical shield 34 and overlap the end of the shield 34, so that the shields 34 and 36 may substantially isolate the inner circular portion of the inside surface of the upper insulating disk 12 from the stationary and movable electrodes 23, 24 and the contact 28. Thus the shields 34 and 36 protect the inner portion of the insulating disk 12 from the deposition of metallic vapors produced by arcing across the electrodes 23 and 24 or the contact 28. The stationary contact rod 21 is provided near its lower end with an annular groove 40 around its periphery into which a ring 41 is fitted and brazed to the rod 21. The upper cup-shaped shield 36 is brazed along the periphery of its center aperture 38 to the lower surface of the ring 41. The lower cup-shaped shield 37 faces downward in such a manner as to cover the opening of the lower cylindrical shield 35 and terminate at its lower end near the same axial position as that of the upper end of the shield 35 when the movable rod 22 is positioned in the closed state as shown in FIG. 1. The lower cup-shaped shield 37 is brazed along the periphery of its center aperture 39 to the upper surface of the flange 30 on the rod 22. Thus the shields 35 and 37 substantially isolate the bellows 29 and the inner circular portion of the inside surface of the lower insulating disk 13 from the electrodes 23, 24 and the contact 28, in order to protect them from the deposition of metallic vapors produced by arcing across the electrodes 23 and 24 or the contact 28.

To manufacture the vacuum circuit interrupter designed as above, first the cylindrical shield 34, the stationary contact rod 21, and the other parts are placed on the insulating disk 12 with brazing metal interposed therebetween to temporarily assemble the stationary section, while the cylindrical shield 35, the bellows 29, the movable contact rod 22, and the other parts are placed on the insulating disk 13 with brazing metal interposed therebetween to temporarily assemble the movable section. Secondly, the temporarily assembled stationary and movable sections are brazed within a vacuum furnace or a furnace filled with a non-oxidizing ambient gas such as hydrogen. Finally, the stationary and movable sections are attached to the respective ends of the metallic cylinder 11 with brazing metal interposed therebetween to temporarily assemble the vacuum circuit interrupter, and the temporarily assembled interrupter is brazed within the vacuum furnace.

Figure 3:
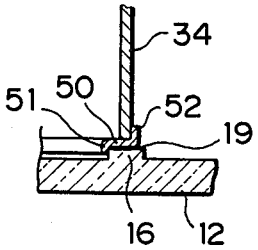
FIG. 3 is a detailed and enlarged view of the engagement between the insulating disk and the cylindrical shield of the vacuum circuit interrupter in FIG. 1.

In order to temporarily assemble the stationary section, the insulating disk 12 is supported horizontally so as to make the metalized layers 18, 19 and 20 face upward, and then the supporting member 33 is placed on the metalized layer 18 on the periphery of the aperture 14 in the insulating disk 12 with brazing metal interposed therebetween while the cylindrical shield 34 is placed on the intermediate metalized layer 19 on the disk 12 with brazing metal interposed therebetween. As shown in FIG. 3, the brazing metal 50 interposed between the intermediate metalized layer 19 on the disk 12 and the cylindrical shield 34 is formed by a press or some similar method into a ring provided with annular portions 51 and 52 extending axially at the inner and outer circumferential ends so as to have a crank-shaped section. The brazing metal 50 is provided to facilitate the positioning of the shield 34 with respect to the insulating disk 12 by fitting the annular portion 51 to the shoulder of the annular projection 16 of the disk 12 and also fitting the annular portion 52 to the outer circumference of the shield end 34. Similar crank-shaped rings of brazing metal are employed for the brazing metal interposed between the supporting member 33 and the metalized layer 18, and that interposed between the metallic cylinder 11 and the metalized layer 20. Next, the stationary contact rod 21 is inserted into the supporting member 33 from above, and is engaged with the member 33 by means of the stop ring 32 with brazing metal interposed between the supporting member 33 and the stop ring 32. The cup-shaped shield 36 is fitted to the stationary contact rod 21 and is engaged to the stop ring 41 with brazing metal interposed therebetween. Then, brazing metal is placed on the end of the stationary electrode rod 21, and the stationary electrode 23 is fitted to the rod 21 in the recess 25 thereof.

In order to temporarily assemble the movable section, the insulating disk 13 is supported horizontally so as to make the metalized layers 18, 19 and 20 face upward, and the bellows 29 is placed thereon with brazing metal interposed between its end and the metalized layer 18 on the periphery of the aperture 14 in the disk 13 while the cylindrical shield 35 is placed thereon with brazing metal placed on the intermediate metalized layer 19 on the disk 13. The movable contact rod 22 is inserted into the bellows 29 from above, and the flange 30 is placed on the other end of the bellows 29 with brazing metal interposed therebetween. The cup-shaped shield 37 is fitted to the movable contact rod 22 and is engaged to the flange 30 with brazing metal interposed therebetween. Then, brazing metal is placed on the end of the movable contact rod 22, and the movable electrode 24 is fitted to the end of the rod 22 in the recess 26 thereof. Then, the contact 28 is fitted to the groove 27 in the movable electrode 24 with brazing metal interposed therebetween.

The stationary and movable sections assembled temporarily as mentioned above are placed within the vacuum furnace and heated while the furnace is evacuated so as to make the pressure therein under $10^{-5}$ Torr in order to perform the deaeration treatment of each component. Next, the vacuum furnace is heated to a temperature of 900° C. to 1050° C. in order to activate the surfaces of the austenitic stainless steel, and the components are brazed hermetically to each other while the furnace is evacuated to a pressure lower than $10^{-5}$ Torr. The inside of the vacuum furnace is gradually cooled from the brazing temperature to a predetermined temperature by furnace cooling for example and then cooled gradually again to room temperature after being maintained at the predetermined temperature for a predetermined time, or is gradually cooled continuously from the brazing temperature to room temperature before the stationary and movable sections are taken out from the vacuum furnace.

Brazing the components of the stationary and movable sections cannot only be done inside the vacuum furnace, and may be performed, for example, within deoxidizing ambient gas such as hydrogen allowing the oxidized film of austenitic stainless steel to be removed at a temperature ranging from the minimum brazing temperature determined by the melting point to 1050° C.

The insulating disks 12 and 13 of the stationary and movable sections brazed as described above are fitted to the opposite ends of the metallic cylinder 11 with brazing metal interposed therebetween to assemble temporarily the vacuum circuit interrupter. The temporarily assembled vacuum circuit interrupter is placed vertically within the vacuum furnace before the furnace is evacuated to a pressure under $10^{-4}$ Torr. Then, while the furnace is heated at a temperature of 500° C. to 1050° C. and evacuated to a pressure under $10^{-5}$ Torr, the stationary and movable sections are brazed hermetically to the metallic cylinder 11 simultaneously with the deaeration treatment of each component. After the inside of the vacuum furnace is gradually cooled from the brazing temperature to a predetermined temperature and then cooled gradually again to room temperature after being maintained at the predetermined temperature for a predetermined time, or after the inside of the vacuum furnace is gradually cooled continuously from the brazing temperature to room temperature, the vacuum circuit interrupter is taken out from the furnace.

In the aforementioned manufacturing method, the upper limit of the heating temperature can be made below 900° C. by nickel-plating the brazed portions of the shields 34 and 35, the bellows 29, and the other parts made of austenitic stainless steel beforehand.

The joints between the disks 12 and 13, made of an inorganic insulator such as alumina ceramic or the like and the metallic cylinder 11, made of copper or iron, can be made to have an adequate airtight property and mechanical strength although the thermal expansion coefficients thereof are extremely different from each other. As shown by the solid curves in FIG. 4 the tensile strengths of copper and iron increase according to the fall of the temperature, whereas as is shown by the broken curves the rates of expansion thereof approximately decrease according to the fall of the temperature. Therefore, when the metallic cylinder 11 of copper or iron is brazed to the disks 12 and 13, of inorganic insulator such as alumina ceramic or the like, at a high temperature of 900° C. to 1050° C., the cylinder 11 is plastically deformed, according to the thermal stress caused during brazing, in the gradual cooling process since the tensile strength thereof is extremely small relative to the mechanical strength of the disks 12 and 13. Thus the airtight property of the joints therebetween is not damaged and the residual thermal stress is made extremely small when the assembly is cooled to room temperature.

Figure 4:
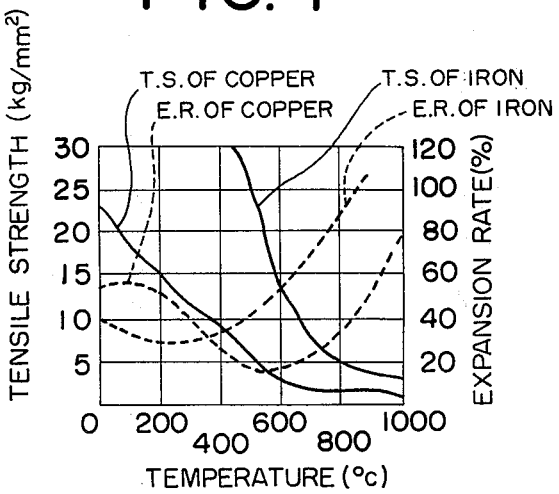
FIG. 4 is a graph of tensile strength and rate of expansion against temperature for copper and iron, where the solid curves indicate the tensile strengths while the broken curves indicate the rate of expansion.

Iron can be joined hermetically to an inorganic insulator to form a structure with an increased mechanical strength similarly to copper although the tensile strength thereof at every temperature is greater than that of copper as is shown by the solid curves in FIG. 4 and the creep thereof against time under constant loading is less than that of copper, since the thermal expansion coefficient thereof is roughly less than that of copper as shown by the broken curves in FIG. 4.

The joint between the disk 13, of an inorganic insulator such as alumina ceramic or the like, and the bellows 29, of austenitic stainless steel, can be made to have an adequate airtight property and mechanical strength, since the bellows 29 is approximately 0.1 to 0.2 mm in thickness and the thermal stress caused by brazing is extremely small relative to the mechanical strength of the disk 13 and consequently the bellows 29 itself deforms plastically in the gradual cooling process.

It should be understood that further modifications and variations may be made in the present invention without departing from the spirit and scope of the present invention as set forth in the appended claims.

What is claimed is:

1. A vacuum circuit interrupter comprising:

(a) a plastically deformable metallic cylinder (11);

(b) first and second insulating disks (12, 13) closing the opposite ends of the metallic cylinder to form therewith an evacuated envelope (10), the first and second disks each having a coaxial center aperture (14);

(c) a stationary conductive rod (21) coaxially entering the envelope through the center aperture of the first disk, the stationary rod being fixed to the first disk in such a manner as to provide a seal thereabout;

(d) a movable conductive rod (22) coaxially and movably entering the envelope through the center aperture of the second disk in such a manner as to align with the stationary rod;

(e) a bellows (29) surrounding the movable rod inside the envelope, the bellows being fixed at its one end to the movable rod and at its other end to the second disk in such a manner as to provide a seal about the movable rod to allow for movement thereof without impairing the vacuum inside the envelope;

(f) stationary and movable electrodes (23, 24) connected to the stationary and movable rods respectively in such a manner as to engage with each other when the movable rod moves toward the stationary rod and disengage when the movable rod moves away from the stationary rod;

(g) a first conductive shield (34) surrounding the stationary rod inside the envelope, the first shield being fixed to the first disk in such a manner as to be isolated electrically from the stationary rod and the metallic cylinder; and (h) a second conductive shield (35) surrounding the bellows inside the envelope, the second shield being fixed to the second disk in such a manner as to be isolated electrically from the movable rod and the metallic cylinder.

2. A vacuum circuit interrupter as defined by claim 1, further comprising first and second coaxial annular metalized layers (19) formed on the inner surfaces of the first and second disks respectively, the first and second shields being shaped cylindrically and coaxially being brazed at one end to the first and second metalized layers respectively.

3. A vacuum circuit interrupter as defined by claim 1, wherein the stationary and movable electrodes are each in the form of a disk and are coaxially connected to the inner ends of the stationary and movable rods respectively, the movable electrode having a coaxial annular contact (28) on its end surface adjacent to the stationary electrode, the contact engaging and disengaging with the stationary electrode according to the movement of the movable rod.

4. A vacuum circuit interrupter as defined by claim 2, further comprising third and fourth cup-shaped shields (36, 37) of larger diameters than those of the first and second shields, the third and fourth shields coaxially connected to the stationary and movable rods respectively in such a manner that the third shield covers the opening of the first shield to substantially isolate the inner circular portion of the inside surface of the first disk from the stationary and movable electrodes, and that the fourth shield covers the opening of the second shield to substantially isolate the bellows and the inner circular portion of the inside surface of the second disk from the stationary and movable electrodes.

* * * * *

UNITED STATES PATENT AND TRADEMARK OFFICE

CERTIFICATE OF CORRECTION

PATENT NO. : 4,414,448

DATED : November 8, 1983

INVENTOR(S) : Kashimoto et al.

It is certified that error appears in the above-identified patent and that said Letters Patent is hereby corrected as shown below:

column 2, lines 7 & 8, change "expansion" to --elongation--.

column 2, line 10, change "expansion" to --elongation--.

column 2, lines 35 & 36, delete "according to the thermal stress generated during brazing".

column 3, line 44, change "raize" to --raise--.

column 5, line 27, change "deaeration" to --degassing--.

column 5, line 62, change "deaeration" to --degassing--.

column 6, line 18, change "expansion" to --elongation--.

column 6, line 25, delete "caused during brazing,".

column 6, line 46, delete "caused by brazing".

Figure 4, change "expansion" to --elongation--.

Signed and Sealed this

*Nineteenth* Day of *June 1984*

[SEAL]

*Attest:*

GERALD J. MOSSINGHOFF

*Attesting Officer*

*Commissioner of Patents and Trademarks*